United States Patent [19]

Kuhn et al.

[11] 4,234,651

[45] Nov. 18, 1980

[54] PROCESS FOR THE MANUFACTURE OF A NON-WOVEN PRODUCT HAVING HIGH SHEAR STRENGTH AND DIMENSIONAL STABILITY

[75] Inventors: Helmut Kuhn, Königstein; Kurt Seiler, Abtsteinach, both of Fed. Rep. of Germany

[73] Assignee: Hoechst Aktiengesellschaft, Frankfurt am Main, Fed. Rep. of Germany

[21] Appl. No.: 904,996

[22] Filed: May 11, 1978

[30] Foreign Application Priority Data

May 14, 1977 [DE] Fed. Rep. of Germany ..... 2721959

[51] Int. Cl.[3] ..... B32B 27/00

[52] U.S. Cl. ..... 428/290; 156/148; 428/300; 428/301; 428/480

[58] Field of Search ..... 156/148; 428/296, 300, 428/301, 375, 290, 480; 260/855, 856, 852

[56] References Cited

U.S. PATENT DOCUMENTS 3,967,032 6/1976 Plotz et al. ..... 428/301

4,125,663 11/1978 Eckardt ..... 428/290

*Primary Examiner*—James J. Bell

*Attorney, Agent, or Firm*—Curtis, Morris & Safford

[57] ABSTRACT

Spunlaid products are provided especially for the manufacture of substrates for polyvinyl chloride coated structured floor coverings. These products consist of crimpfree polyester filaments which are laid down and bonded. Bonding is carried out first by needling at 80 to 300 stitches/cm$^2$ to a stitch depth of 11 to 20 mm. After needling, impregnation is carried out using a binder liquor consisting of an aqueous dispersion of a copolymer containing from 47 to 59 weight % of styrene
from 33 to 45 weight % of butadiene
from 3 to 4 weight % of acrylic acid
from 3 to 4 weight % of acrylic acid amide and small amounts of emulsifiers. The binder liquor may also contain the said copolymer and, in addition, from 0.5 to 2 weight % (relative to the copolymer) of a melamine/formaldehyde precondensate etherified with methanol which was prepared using at least one acidic catalyst.

4 Claims, 2 Drawing Figures

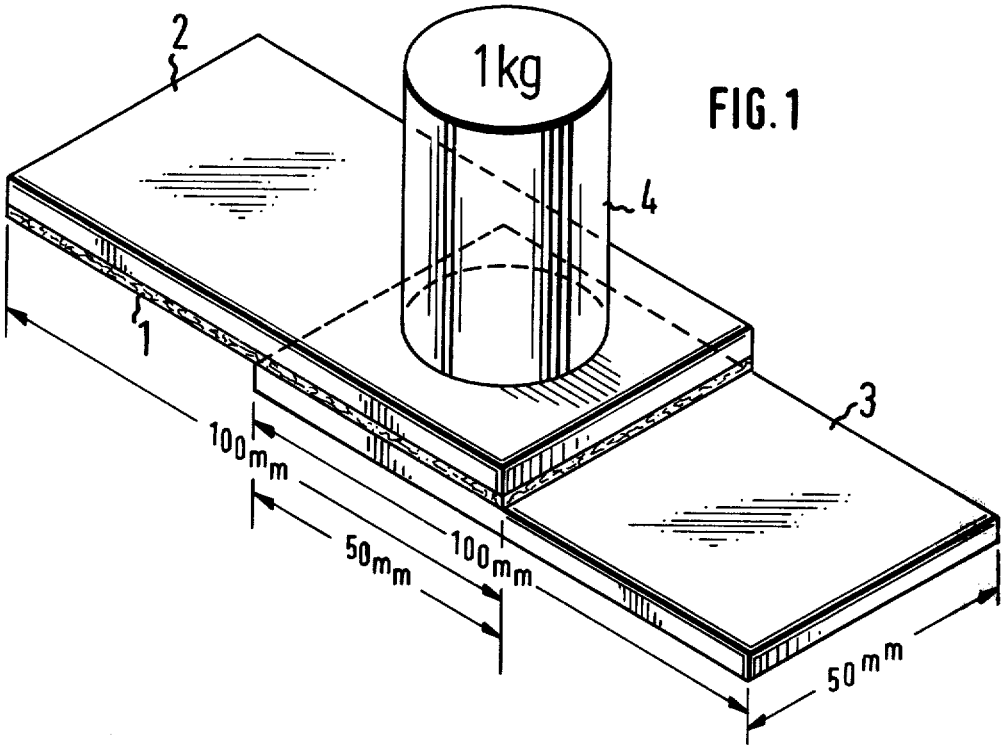
FIG. 1
FIG. 2
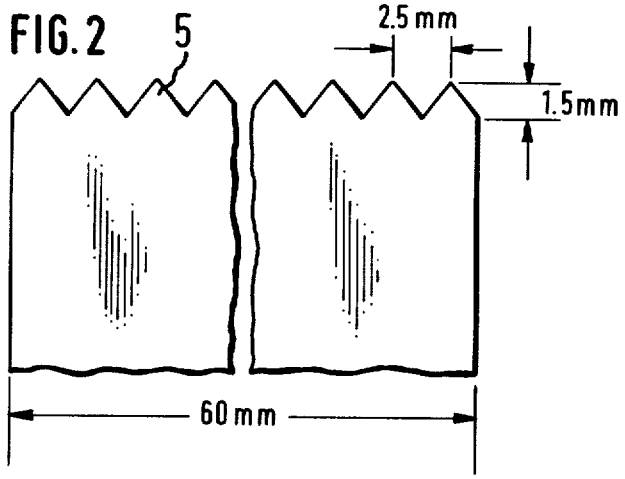

PROCESS FOR THE MANUFACTURE OF A NON-WOVEN PRODUCT HAVING HIGH SHEAR STRENGTH AND DIMENSIONAL STABILITY

The present invention provides a process for the manufacture of a non-woven product of crimp-free polyester filaments by deposition and special bonding of the filaments.

For the manufacture of cushioned vinyls (polyvinyl chloride-coated structured floor coverings) asbestos paper having a thickness of from 0.6 to 1.0 mm is generally used hitherto as substrate. Although it supplies the required properties of dimensional stability at high gelling temperatures, of a sealed yet still adhesive surface, of minimum thickness at simultaneously good shear strength and sufficient flexibility, these favorable properties are completely overbalanced by the following disadvantages:

(a) Because of the inevitable dust formation during the manufacturing process and on removal of these coverings from the floor, there is the risk that the corresponding personnel becomes affected by asbestosis, so that already in Sweden this product is not applied any more.

(b) The low breaking strength at incidental folding or bending (see Table) results in high susceptibility to damage while the final product is being laid out, and therefore a correspondingly high rate of wastes.

(c) The relatively high fabric weight (about 600 to 1000 g/m$^2$) causes increased transport costs of the final product.

In order to avoid the risk of asbestosis, thin glass fiber webs having a weight of 50 to 100 g/m$^2$, which are coated on both sides with polyvinyl chloride, have been used in several cases as substrates in cushioned vinyls, involving the following disadvantages:

irritation of the skin by fragments of glass fibers, high risk of tear initiation and tear propagation when laying out the material (see Table), and unprofitability because of the bilateral polyvinyl chloride coating.

Spunbonds with binder fibers which had melting points below 220° C., did not display the intended dimensional stability at gelling temperatures substantially higher than 200° C.

Hitherto employed spunlaid products bonded mechanically and/or by adhesives were unfit for the processes of cushioned vinyl manufacture, because they did not display simultaneously all the following properties: a minimum shear strength of 80 N/cm$^2$, preferably more than 150 N/cm$^2$, a thermodimensional stability in machine (longitudinal) direction at 473 kelvins expressed by a maximum elongation of 8%, preferably 4, a similar minimum thermodimensional stability in cross (transversal) direction of 8%, a thickness of 0.6 to 2 mm, preferably 1.0 to 1.5 mm, a weight per square meter of 150 to 400 g, preferably 200 to 300g, a flexibility allowing a sample to be bent around a tube of 100 mm diameter without showing pronounced breaks.

It is the object of the present invention to provide a process for the manufacture of a substrate for cushioned vinyls which is free from the disadvantages occuring with the hitherto used base materials, but which can nevertheless be manufactured and applied in an economic manner.

BRIEF DESCRIPTION OF THE DRAWINGS

FIGS. 1 and 2 illustrate the procedure used to test the shear strength of the non-woven product prepared in accordance with the invention.

The required high shear strength (cohesion of the filament layers) with simultaneously high dimensional stability at elevated temperatures, the simultaneously required minimum thickness, smoothness and compactness of the surface at acceptable flexibility could not be attained hitherto by the needling technique and the binders applied until now for spunlaid fabrics.

Only a combination of a non-woven material of filaments having the fineness indicated further below, a needling of unusual intensity as compared to spunlaid products bonded by adhesives, and an additional reinforcement by means of determined binders succeeded in meeting the above requirements.

For the manufacture of the non-woven product in accordance with this invention, having an unit area weight of 150 to 400 g/m$^2$, preferably from 200 to 300 g/m$^2$, the starting material used was polyester filaments, preferably polyethyleneglycol terephthalate filaments, being crimp-free as well as free from any fiber preparation and lubricants, having a diameter of from 14 to 31 microns, preferably 18 to 24 microns, obtained according to the spunbond process and deposited in random distribution, and this spunlaid web was needled in such a manner that, depending on the area weight of the final product, there resulted, after the subsequent impregnation a thickness of from 0.6 to 2.0 mm, preferably 1.0 to 1.5 mm; a surface showing only slightly conspicuous stitch marks of the needles and protruding fibers or fiber tufts; a shear strength (according to the test method indicated further below) of more than 80 N/cm$^2$, preferably 100 to 120 N/cm$^2$; a thermodimensional stability (also measured according to a test method described further below) at 473 kelvins expressed by an elongation of 8%, preferably 4%, in machine direction, and of 8% in cross direction; and also a good flexibility.

Most of the needlings of spunlaid products used hitherto with subsequent bonding by adhesion, were used to obtain a maximum tensile strength. In contrast to the non-woven products made from staple fibers (short, crimped fibers) where a maximum tensile strength is obtained only after 200 to 400 stitches/cm$^2$, this maximum tensile strength is obtained after 30 to 70 stitches/cm$^2$ in the case of spunlaid products being free from any fiber preparation and lubricants. More stitches cause a high percentage of the continuous filaments to be torn, and thus reduce the tensile strength of the spunlaid product. In combination with the binder used in accordance with this invention, and while employing the needles as indicated further below, it was possible to increase the number of stitches while substantially maintaining the tensile strength and simultaneously obtaining a considerable increase in the shear strength of the polyethylene terephthalate spunlaid product.

Although, in contrast to the needling described in German Offenlegungsschrift No. 1 948 553, the application of any fiber preparation or lubricant was renounced, no breaking of the needles was observed when using the above polyethylene terephthalate filaments and the needles described below.

By a number of from 80 to 300 stitches/cm$^2$, preferably 80 to 150 stitches/cm$^2$, and with the use of fine needles having close positioned beards (as they are marketed for example by Singer under the order number 4135-742-050), the depth of the stitches being from 11 to 20 mm, preferably 12 to 17 mm, and the needling being unilateral, good compactness with only a few protruding fibers could be achieved on the surfaces. While this quality of the surface may be obtained likewise by other needles, numbers of stitches per $cm^2$ and depths of stitches, a high and constant shear strength, (after the adhesive bonding) requires more than 70 stitches/$cm^2$, a dense penetration of filament sections per stitch in vertical direction to the surface of the spunlaid product, and the absence of lubricants.

The above high shear strength with simultaneously sufficient flexibility and smooth surface of the final product is not obtained by the needling technique alone, but only in combination with the binders used and with drying by suction drum. The binders are chosen in such a manner that the structure stiffening binder points at the crossings of the crimp-free filaments, free, from any fiber preparation and, lubricants supply the adhesion which is decisive for the high shear strength. The aforementioned relative low denier of the filaments ensures that there are correspondingly more crossing points than in the case of coarse filaments and a corresponding distribution of many binder-reinforced places and thus the resulting high shear strength.

This operation mode as indicated not only ensures this high minimum shear strength, but also a high thermodimensional stability—on condition that a binder having a high softening point is used—and simultaneously an acceptable flexibility at room temperature. In order to meet the requirements, a binder was chosen which consists of a dispersion of a determined copolymer. The binder liquors which yielded spunlaid products having the intended properties were prepared from an aqueous dispersion of a copolymer containing from 47 to 59 weight % of styrene, from 33 to 45 weight % of butadiene, and from 6 to 8 weight % of acrylic acid and its derivatives, besides small amounts of emulsifiers. There may be added from 0.5 to 2 weight % (relative to the copolymer) of a water-soluble melamine/formaldehyde precondensate etherified with methanol, and the usual acidic catalysts necessary for such condensation (for example ammonium chloride, zinc chloride, glyoxal and the like), in order to control the flexibility.

An amount of from 17 to 30 weight %, preferably 20 to 27 weight %, relative to the fiber substance of the spunlaid product of binder solids was applied to the mechanically bonded spunlaid product, the impregnated non-woven product was dried, and the binder condensed at temperatures of from 400 to 500 kelvins. Copolymers having higher styrene contents, as they are described for example in German Utility Model Specification No. 76 13 886.8, did not bring about the flexibility required in this field of application.

For measuring the properties of the non-woven product manufactured according to this invention, the following test methods were used:

Determination of the grammage according to German Industrial Standard DIN 52 854.

Determination of the thickness according to DIN 16 952, Sheet 1.

Determination of the maximum tensile strength and the maximum elongation at break according to DIN 53 857, using a test apparatus the clamping devices of which are adjusted to a constant rate of tear.

Determination of the tear resistance according to DIN 53 859, Sheet 2.

The shear strength, the thermodimensional stability, the flexural fatigue strength, and the flexibility were measured according to methods not standardized as yet.

For testing the shear strength, a sample 1 of the spunlaid product having a dimension of 50×100 mm was bonded to a molded fiber board 2 having the same dimensions and a thickness of 4.25 mm by means of a solvent containing adhesive suitable for bonding cushioned vinyls containing a polyester substrate, for example Thomsit$^{(R)}$ T 470, while strictly observing the operational prescriptions given by the manufacturer of the adhesive. The adhesive was applied to the smooth side of the molded fiber board by means of a toothed metal spatula 5, (24 teeth per 60 mm width, depth of tooth 1.5 mm) (see FIG. 2 of accompanying drawing). A second molded fiber board 3 having the above dimensions, also on its smooth side and using the same adhesive, was bonded to the free side of the spunbond in such a manner that half of the spunlaid product was thus covered, and 50×50 mm remained open. Subsequently, this specimen, that is, that area of spunlaid product of 50×50 mm which was bonded on both sides to the molded fiber boards, was subjected for 1 hour to a weight 4 of 1 kg (see accompanying drawing, FIG. 1). The drying time for the adhesive cited above as example is 24 hours at room temperature; for other adhesives, the drying time has to be evaluated by tests if the manufacturer has not given any corresponding indication.

The shear strength is tested by clamping both ends of the specimens into the clamping devices (one of them must not be mounted rigidly) of a corresponding apparatus designed for the intended stress, provided with a recording device for the maximum stress occurring, which apparatus must ensure a constant speed of the clamping devices. Normally, on tearing, the spunlaid product is fissured near the bonded area. A fissure along a filament layer in the interior of the spunlaid product is generally identical to low shear strength (less than 60 N/$cm^{22}$).

The values of thermodimensional stability are determined at a temperature of 473 kelvins and a load of 400 N/m. The specimen having a width of 100 mm and a length of 300 mm is clamped between 2 clamping devices (clamping length 200 mm) and a distance of 100 mm is marked between them. After having attached the upper clamping device in a drying chamber having the above temperature, the lower one is subjected to a load of 40 N. After 20 minutes, the elongation observed is measured and indicated in percent. The maximum elongation of all spunlaid products described, regardless of weight per square meter and thickness, is 8%, preferably 4%, in machine direction, and 8% in cross direction.

The flexibility was tested by bending a sample of the substrate having the dimensions of German Industrial Standard DIN A 4 around a cylinder having a diameter of 100 mm. No pronounced break must occur in the sample if it is to meet the requirements. Although the result cannot be measured numerically and is not completely free from subjective influence, this is the usual method for testing the flexibility of substrates for floor coverings.

The flexural fatigue strength was tested on a corresponding testing apparatus according to Schopper, as it is manufactured for example by the company K. Frank GmbH, Weinheim-Birkenau, West-Germany. In this test, the specimen having a dimension of 200×30 mm is bent at the same determined place with a load of 20% of the tensile strength at a frequency of 108 phases/min. (1 phase = 2 × 180°). This test method is described by E. Wagner, Mechanisch-technologische Textilprüfungen, 7th edition, ed. Dr. Spohr, Wuppertal-Elberfeld (1963) pp. 98/99.

The following Examples, illustrating the invention, show manufacturing modes for the described products, and Comparative Examples of spunlaid products prove that these non-woven products do not meet the requirements.

EXAMPLE 1

Filaments of polyethyleneglycol terephthalate, being free from crimp, from any fiber preparation and from lubricants, having a diameter of 21 microns, were prepared according to the spunbond method, deposited in random distribution to form a web of 200 g/cm², and needled by means of Singer needles of the order number 4135-742-050, at a depth of stitch of 15 mm on a first needling machine (60 stitches/cm²) and at a depth of stitch of 11 mm on a second needling machine (60 stitches/cm²). Subsequently, the needled product was impregnated with an impregnation liquor prepared by dilution of a dispersion of a copolymer containing the following solids amounts: 12.2 weight % of styrene, 10.9 weight % of butadiene, 1 weight % of acrylic acid, 0.9 weight % of acrylamide and small amounts of an emulsifier. At a squeezing effect of 100%, 25% of solids were applied to the spunlaid product relative to its weight in needled state. Temperature of the suction drum dryer: 473 kelvins. The properties of the product so obtained are listed in the Table, and those of the following Examples as well.

content of 30%, relative ot the weight of the fibers, was obtained.

COMPARATIVE EXAMPLE 1

A spunlaid product having a weight of 200 g/m² was prepared from filaments being free from any fiber preparation and lubricants and having a diameter of 21 microns, prepared according to the spunbond process, and needled with 50 stitches/cm² at a depth of the stitches of 13 mm, and impregnated as described in Example 1.

COMPARATIVE EXAMPLE 2 (according to German Pat. No. 2,345,484)

A spunlaid product of 208 g/m², diameter of the filaments 29 microns, needled with 90 stitches/cm² at a depth of stitch of 16 mm, was impregnated with an aqueous liquor prepared from the dispersion of a copolymer of 50% of butyl acrylate, 25% of acrylonitrile, 23% of styrene and 2% of acrylamide, with the addition of 4.5% of a precondensate of melamine-trimethylol-trimethyl ether and formaldehyde (relative to the solids amount of the copolymer dispersion). Binder coat (relative to the fiber weight of the needled spunbond): 20% Condensation temperature: 473 kelvins.

COMPARATIVE EXAMPLE 3

According to Example 1, but with the use of a binder as indicated in Example 1 of German Utility Model Specification No. 76 13 886.8.

COMPARATIVE EXAMPLE 4

According to Comparative Example 1, but with the use of a binder as in Comparative Example 3.

TABLE

| Properties | Asbestos paper | Glass fiber fleece bilaterally coated | Test specimens E ↑ | E 2 | E 3 | CE ↑ | CE 2 | CE 3 | CE 4 |
|---|---|---|---|---|---|---|---|---|---|
| Area weight (g/m²) | 1030 | — | 250 | 200 | 250 | 250 | 250 | 250 | 250 |
| Thickness (mm) | 0.9 | — | ↑.22 | ↑.07 | ↑.20 | ↑.40 | ↑.65 | — | — |
| Shear strength (N/cm²) | 9.6 | — | > ↑05*) | > ↑05*) | > ↑05*) | 7↑ | 59 | — | — |
| Thermodimensional/longit. | ↑.8 | — | 3.2 | 3.7 | ↑.7 | 4.0 | 3.5 | — | — |
| stability (%)/transv. | 0 | — | 5.0 | 6.5 | 3.5 | 6.7 | 5.2 | — | — |
| Shrinkage 200° C. (%) | 0 | — | < ↑ | < ↑ | < ↑ | < ↑ | < \| | — | — |
| Maximum tensile/longit. | 44 | — | 74 | 60 | 7↑ | 79 | 66 | — | — |
| strength (daN/5cm)/transv. | 38 | — | 68 | 50 | 66 | 73 | 67 | — | — |
| Maximum elongation/longit. | 9 | — | 42 | 41 | 40 | 32 | 47 | — | — |
| at break (%)/transv. | ↑↑ | — | 48 | 43 | 43 | 34 | 53 | — | — |
| Flexural Fatigue strength (phases) | 8 | — | >5000 | — | — | — | — | — | — |
| Tear propagation/longit. | 0.35 | 0.46 | 4.7 | — | — | — | — | — | — |
| strength (daN)/transv. | 0.39 | 0.44 | 4.↑ | — | — | — | — | — | — |
| Flexibility | good | — | good | good | good | sufficient | sufficient | insufficient | insufficient |

E = Example
CE = Comparative Example
(*) breaking of the molded fiber boards at 105 N/cm²
— not tested

EXAMPLE 2

According to Example 1, with the exception that the spunlaid product had a weight of 160 g/m².

EXAMPLE 3

According to Example 1, with the exception that a spunlaid product having a weight of 192 g/m² was used as well as an aqueous binder liquor having the following contents of solid matter: 14.7 weight % of styrene, 12.5 weight % of butadiene, 1.2 weight % of acrylic acid, 1 weight % of acrylamide and 0.5 weight % of a precondensate of melamine-trimethylol-trimethyl ether and formaldehyde. At a squeezing effect of 100 %, a solids

What is claimed is:

1. A process for the manufacture of a spunlaid product of crimp-free polyester filaments by deposition and bonding of the filaments, wherein the filaments consist of polyethyleneglycol terephthalate, and the bonding is obtained by needling and subsequent impregnation with a binder liquor; the needling being carried out by placing 80 to 300 stitches/cm², preferably 80 to 150 stitches/cm² at a depth of stitch of 11 to 20 mm, preferably 12 to 17 mm; and the impregnation being carried out with an aqueous dispersion of a copolymer containing from 47 to 59 weight % of styrene,
from 33 to 45 weight % of butadiene,
from 3 to 4 weight % of acrylic acid and
from 3 to 4 weight % of acrylic acid amide.

2. Spunlaid product consisting of crimp-free polyester filaments deposited in random distribution, wherein the filaments consist of polyethylene terephthalate and the spunlaid web is bonded by needling and impregnated in such a manner that it contains from 10 to 30 weight %, preferably 20 to 27 weight %, relative to the fiber substance, of binder solids, the binder solids consisting essentially of a copolymer containing from 47 to 59 weight % of styrene,
from 33 to 45 weight % of butadiene,
from 3 to 4 weight % of acrylic acid and
from 3 to 4 weight % of acrylic acid amide.

3. A process according to claim 1 wherein from 0.5 to 2 weight percent (relative to the copolymer) of a melamine/formaldehyde precondensate is added to the aqueous dispersion.

4. A spunlaid product according to claim 2, wherein the copolymer additionally contains from 0.5 to 2 weight percent (relative to the copolymer) of a melamine/formaldehyde precondensate.

* * * * *